US008500395B2

(12) United States Patent
Roby et al.

(10) Patent No.: US 8,500,395 B2
(45) Date of Patent: Aug. 6, 2013

(54) TURBOCHARGER VANE

(75) Inventors: Steve Roby, Asheville, NC (US); David M. Decker, Arden, NC (US); Dietmar Metz, Meckenheim (DE)

(73) Assignee: BorgWarner Inc., Auburn Hills, MI (US)

( * ) Notice: Subject to any disclaimer, the term of this patent is extended or adjusted under 35 U.S.C. 154(b) by 1026 days.

(21) Appl. No.: 12/525,724

(22) PCT Filed: Feb. 14, 2008

(86) PCT No.: PCT/US2008/053997

§ 371 (c)(1), (2), (4) Date: Aug. 4, 2009

(87) PCT Pub. No.: WO2008/101105

PCT Pub. Date: Aug. 21, 2008

(65) Prior Publication Data

US 2010/0098529 A1 Apr. 22, 2010

Related U.S. Application Data

(60) Provisional application No. 60/890,110, filed on Feb. 15, 2007.

(51) Int. Cl.
*F01D 9/04* (2006.01)

(52) U.S. Cl.
USPC ..... 415/164; 415/165

(58) Field of Classification Search
USPC ..... 415/163, 164, 165, 191
See application file for complete search history.

(56) References Cited

U.S. PATENT DOCUMENTS

| | | | | |
|---|---|---|---|---|
| 4,770,603 | A * | 9/1988 | Engels et al. | 415/147 |
| 6,283,705 | B1 * | 9/2001 | Rice et al. | 415/160 |
| 6,419,464 | B1 * | 7/2002 | Arnold | 417/407 |
| 6,461,105 | B1 * | 10/2002 | Nicolson | 415/160 |
| 7,255,530 | B2 * | 8/2007 | Vogiatzis et al. | 415/159 |

FOREIGN PATENT DOCUMENTS

| | | | |
|---|---|---|---|
| JP | 61192520 | U | 8/1986 |
| JP | 61268804 | A | 11/1986 |
| JP | 01039434 | U | 3/1989 |
| JP | 11504092 | A | 4/1999 |
| JP | 11229815 | A | 8/1999 |
| WO | 9621094 | A1 | 7/1996 |

* cited by examiner

*Primary Examiner* — Ninh H Nguyen
(74) *Attorney, Agent, or Firm* — William G. Anderson; Stephen A. Pendorf; Patent Central LLC

(57) ABSTRACT

A vane (234) is provided which reduces leakage of gas in a variable geometry turbocharger (210) from the high pressure side of the vane (234) to the low pressure side of the vane (234). The vane (234) can have a channel (330, 430) along a gas bearing surface (325, 425) for reducing the leakage. The channel (330, 430) can be defined at least in part by sideplates (300, 350). The sideplates (300, 350) can be integrally cast with the rest of the vane (234). At least one of the sideplates (300, 350) can have a hole therein for a vane shaft (228) which allows movement of the vane (234) for gas flow control. The sideplates (300, 350) can have edges (301, 351) that conform to the shape of the gas bearing surface (325, 425).

19 Claims, 13 Drawing Sheets

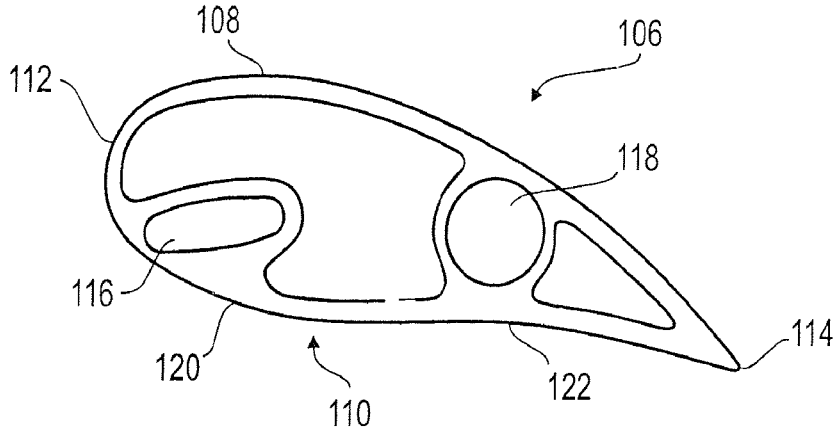
FIG. 1 (Stand der Technik)
(Prior Art)
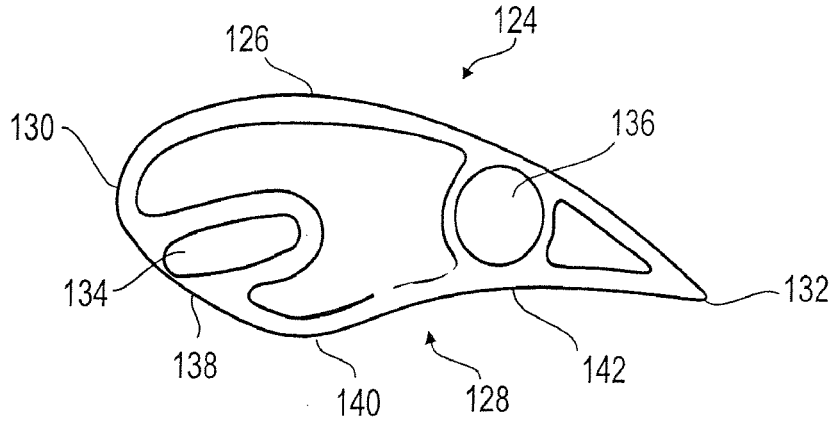
FIG. 2 (Stand der Technik)
(Prior Art)

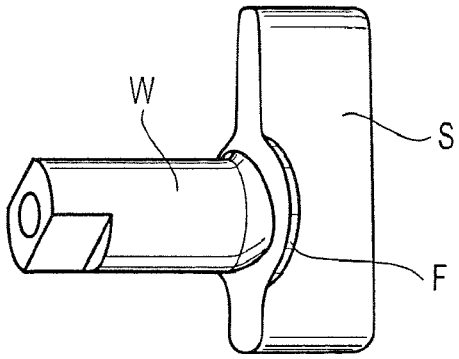
FIG. 17 Stand der Technik
Prior Art
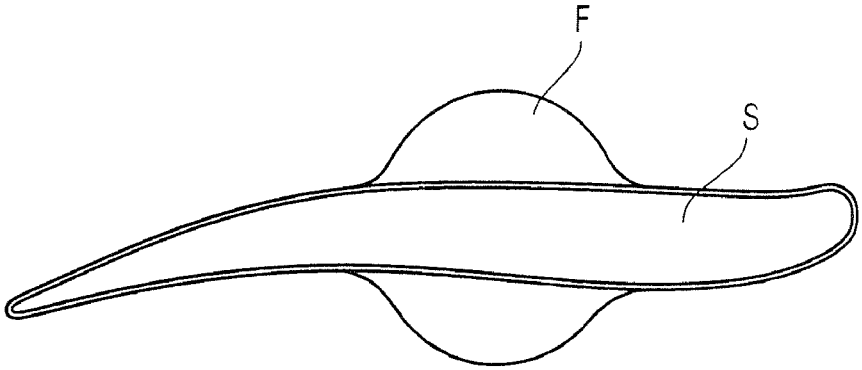
FIG. 18 Stand der Technik
Prior Art

TURBOCHARGER VANE

FIELD OF THE INVENTION

The invention relates in general to turbochargers and, more particularly, to vanes for use in variable geometry nozzles.

BACKGROUND OF THE INVENTION

Turbochargers are widely used on internal combustion engines and, in the past, have been particularly used with large diesel engines, especially for highway trucks and marine applications.

More recently, in addition to use in connection with large diesel engines, turbochargers have become popular for use in connection with smaller, passenger car power plants. The use of a turbocharger in passenger car applications permits selection of a power plant that develops the same amount of horsepower from a smaller, lower mass engine. Using a lower mass engine has the desired effect of decreasing the overall weight of the car, increasing sporty performance, and enhancing fuel economy. Moreover, use of a turbocharger permits more complete combustion of the fuel delivered to the engine, thereby reducing the overall emissions of the engine, which contributes to the highly desirable goal of a cleaner environment.

The design and function of turbochargers are described in detail in the prior art, for example, U.S. Pat. Nos. 4,705,463, 5,399,064, and 6,164,931, the disclosures of which are incorporated herein by reference.

Turbocharger units typically include a turbine operatively connected to the engine exhaust manifold, a compressor operatively connected to the engine air intake manifold, and a shaft connecting the turbine and compressor so that rotation of the turbine wheel causes rotation of the compressor impeller. The turbine is driven to rotate by the exhaust gas flowing in the exhaust manifold. The compressor impeller is driven to rotate by the turbine, and, as it rotates, it increases the air mass flow rate, airflow density and air pressure delivered to the engine cylinders.

As the use of turbochargers finds greater acceptance in passenger car applications, three design criteria have moved to the forefront. First, the market demands that all components of the power plant of either a passenger car or truck, including the turbocharger, must provide reliable operation for a much longer period than was demanded in the past. That is, while it may have been acceptable in the past to require a major engine overhaul after 80,000-100,000 miles for passenger cars, it is now necessary to design engine components for reliable operation in excess of 200,000 miles of operation. It is now necessary to design engine components in trucks for reliable operation in excess of 1,000,000 miles of operation. This means that extra care must be taken to ensure proper fabrication and cooperation of all supporting devices.

The second design criterion that has moved to the forefront is that the power plant must meet or exceed very strict requirements in the area of minimized $NO_x$ and particulate matter emissions. Third, with the mass production of turbochargers, it is highly desirable to design a turbocharger that meets the above criteria and is comprised of a minimum number of parts. Further, those parts should be easy to manufacture and easy to assemble, in order to provide a cost effective and reliable turbocharger.

Turbocharger efficiency over a broad range of operating conditions is enhanced if the flow of motive gas to the turbine wheel can be controlled, such as by making the vanes pivotable so as to alter the geometry of the passages therebetween. The design of the mechanism used to effect pivoting of the vanes is critical to prevent binding of the vanes. Other considerations include the cost of manufacture of parts and the labor involved in assembly of such systems.

Additionally, the design of the vane is critical to both the efficiency of the gas delivery to the turbine, as well as the reliability of the variable geometry assembly. While movement of the vanes allows for control of the gas delivery, it also adds the problem of leakage past the moveable vanes. Additionally, due to the extreme environment that the moveable vanes are placed in, the structure of the vanes, especially where pivotally connected via vane posts and the like, must be sound to avoid failure.

In U.S. Pat. No. 6,679,052 to Arnold, the Applicant attempted to improve efficiency of the air delivery to the turbine wheel by providing a vane having a convex portion adjacent the leading edge and a concave portion adjacent the vane trailing edge. As shown in FIG. 1, the Arnold vane 106 has an outer surface 108, an inner surface 110, a leading edge 112, a trailing edge 114, an actuation tab 116, and a post hole 118. The leading edge 112 is characterized by having a larger radius of curvature such that an adjacent portion of its outer surface 108 is located a greater distance from the actuation tab 116, thereby increasing the airfoil thickness of the vane adjacent the leading edge. The inner surface 110 has a shape that is defined by two differently shaped sections. Moving from the leading edge 112, the inner surface has a convex-shaped portion 120 that is defined by a radius of curvature that is greater than that of the leading edge to contour or blend the leading edge into the inner surface. The convex-shaped portion 120 extends from the leading edge 116 to just past the tab 116. Moving from the convex-shaped portion 102, the inner surface has a concave-shaped portion 122 that extends to the vane trailing edge 122.

The Applicant in Arnold felt that the enlarged and upwardly oriented leading edge and the shape of the inner surface of this vane would operate to provide improved aerodynamic effect. However, the Arnold vane still suffered from the drawback of leakage between the vane and the adjacent components (the upstream and downstream nozzle rings which are not shown.) While the Arnold vane 106 had a curved surface in a longitudinal direction of the vane inner surface 110, it had a flat surface in a traverse direction. Such a flat surface along the inner surface 110 in a traverse direction can provide a substantially uniform pressure profile along the traverse direction and promotes leakage along the side edges of the vane between the vane and the adjacent components such as the nozzle rings between which the vane is sandwiched.

The Applicant in Arnold provided yet another embodiment of a vane that was again intended to provide improved aerodynamic effects and improve efficiency. This other embodiment is shown in FIG. 2 and is a vane 124 having an outer surface 126, an inner surface 128, a leading edge 130, a trailing edge 132, an actuation tab 134, and a post hole 136. The leading edge 130 is characterized by having a somewhat smaller radius of curvature, and the inner surface 128 comprises three differently shaped sections. Moving from the leading edge 130, the inner surface 128 has a downwardly canted generally planar section 138 that extends away from the vane leading edge adjacent the tab 134 at an angle of approximately 45 degrees. The canted section 138 extends for less than about ¼ the total distance along the inner surface and is transitioned to a convex section 140. The convex section is defined by a radius of curvature that is generally less than that used to define the arc of the outer surface 126. The convex section 140 extends along the inner surface to about the mid point of the vane and defines a point of maximum airfoil thickness for the vane.

Similar to the other Arnold embodiment, vane 124 still suffered from the drawback of leakage between the vane and the adjacent components (the upstream and downstream nozzle rings which are not shown). While the Arnold vane 124 had multiple curved surfaces in a longitudinal direction of the vane inner surface 128, it had a flat surface in a traverse direction. Such a flat surface along the inner surface 128 in a traverse direction can provide a uniform pressure profile in the traverse direction and promotes leakage along the side edges of the vane between the vane and the adjacent components such as the nozzle rings between which the vane is sandwiched.

FIG. 17 shows a perspective view of a vane S, which corresponds to the vane illustrated in FIG. 1 of EP-A-1 422 385. As can be seen from FIG. 17, the prior art vane S fastened on the shaft W has a sealing flange F on the vane mounting ring side, said flange being designed to be substantially circular and concentric with the axis of the vane shaft, in order to reduce the leakage flow between the vane shaft and hole in the vane mounting ring and to protect the hole from the ingress of particles.

In order to ensure the mechanical adjustment function of the vane S, an axial gap between the vane S and the vane mounting ring and also the second wall, such as, for example, the disk, is required. However, the leakage flow occurring through this axial gap has a negative impact on the efficiency of the turbocharger, in particular when there are small quantities of exhaust gas. In order to keep the leakage flow losses as small as possible, on the one hand the axial gap has to be designed to be as small as possible and, on the other hand, the highest possible throttling action has to be achieved in the gap.

As can be seen from the cross-sectional view of FIG. 18 of the appended drawing, the only contribution made by the prior art turbocharger to reducing the leakage flow is provided only by an axial length section of the vane, based on its total length, which corresponds substantially to the diameter of the sealing flange F.

Thus, there is a need for a vane that improves sealing in a turbocharger, such as a variable geometry turbocharger. There is a further need for such a vane that is reliable and cost-effective. There is yet a further need for such a vane that facilitates assembly of the turbocharger.

SUMMARY OF THE INVENTION

The present disclosure provides an efficient and cost-effective structure for reducing leakage from the high pressure side of a vane to the low pressure side of the vane in a turbocharger.

In one aspect of an exemplary embodiment of the present invention, a vane for a variable geometry turbocharger is provided comprising: a body having a leading edge, a trailing edge, a gas bearing surface therebetween and a longitudinal channel along the gas bearing surface; and a connection member operably connected to the body and allowing movement of the vane.

In another aspect, a variable geometry turbocharger is provided comprising: an exhaust gas inlet; an exhaust gas outlet; a turbine wheel in fluid communication with the exhaust gas inlet and outlet; a vane having a leading edge, a trailing edge, a gas bearing surface between the leading and trailing edges; and a connection member operably connected to the vane and allowing movement of the vane to control flow of exhaust gas to the turbine wheel, wherein the gas bearing surface is non-planar in a traverse direction.

In another aspect, a method of controlling leakage of gas in a variable geometry turbocharger from the high pressure side of a vane to the low pressure side of the vane is provided. The method comprises providing a gas bearing surface along the high pressure side of the vane and directing flow of at least a portion of the gas towards a center of the gas bearing surface.

BRIEF DESCRIPTION OF THE DRAWINGS

FIG. 1 is a plan view of a vane of a turbocharger according to U.S. Pat. No. 6,679,052;

FIG. 2 is a plan view of another vane of a turbocharger according to U.S. Pat. No. 6,679,052;

FIG. 17 is a perspective view of a vane of the prior art; and

FIG. 18 is a side view of the vane of FIG. 17.

DETAILED DESCRIPTION OF THE INVENTION

Exemplary embodiments described herein are directed to a vane assembly for a turbocharger. Aspects will be explained in connection with several possible embodiments of the vane, but the detailed description is intended only as exemplary. The particular type of turbocharger that utilizes the exemplary embodiments of the vane and vane assemblies described herein can vary. The several embodiments are described with respect to vanes for the turbine wheel, but the present disclosure contemplates use of such vanes with the compressor wheel and/or both. Exemplary embodiments are shown in FIGS. 3-12, but the present disclosure is not limited to the illustrated structure or application.

Figure 3:
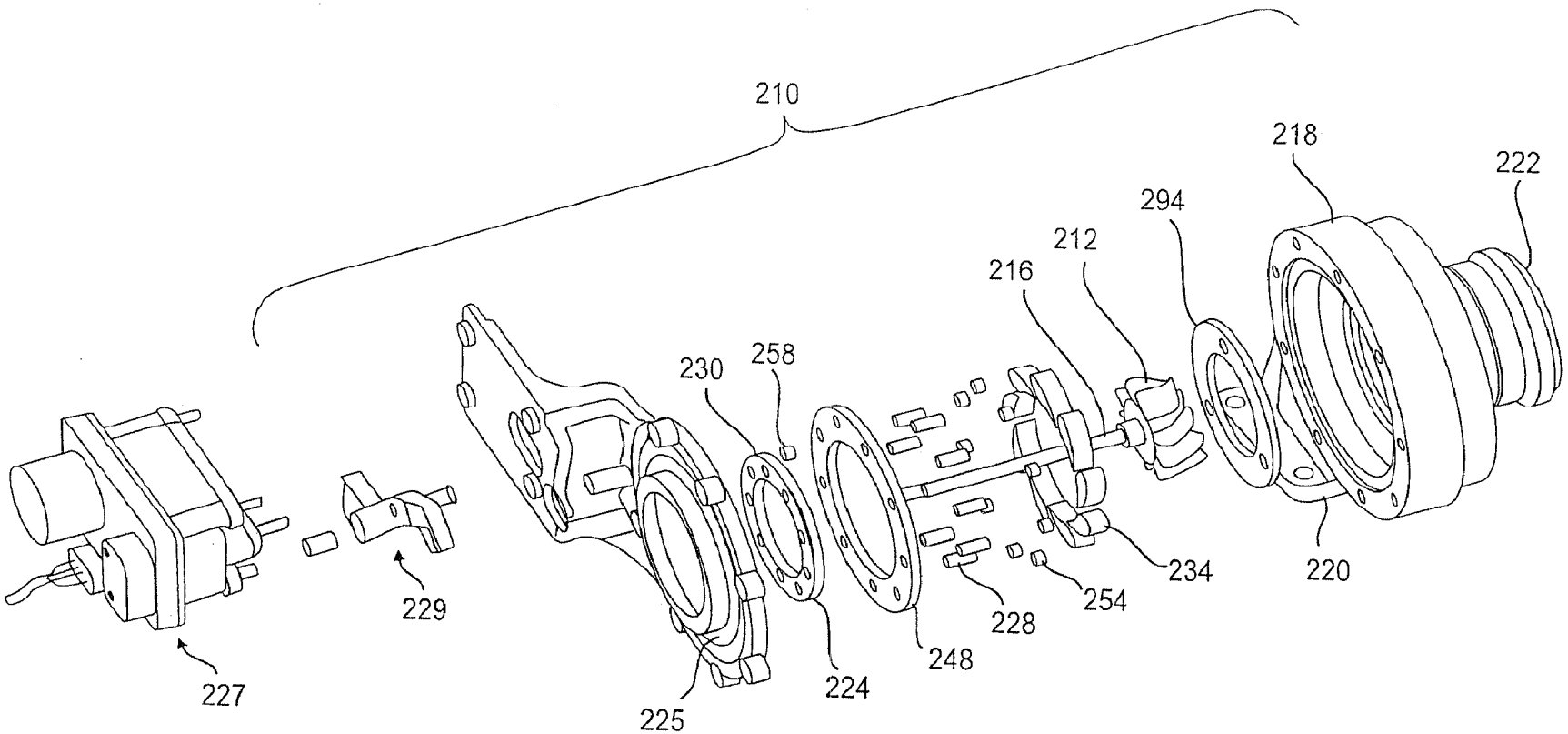
FIG. 3 is an exploded view of a turbocharger according to an exemplary embodiment of the invention.

A turbocharger system as shown in FIG. 3 includes turbomachinery in the form of a turbocharger 210 generally comprising a turbine wheel 212 and a compressor impeller (not shown) mounted on opposite ends of a common shaft 216. The turbine wheel 212 may be disposed within a turbine housing 218 that includes an inlet 220 for receiving exhaust gas from an engine and an outlet 222 for discharging the exhaust gas. The turbine housing 218 guides the engine exhaust gas into communication with and expansion through the turbine wheel 212 for rotatably driving the turbine wheel 212. Such driving of the turbine wheel 212 simultaneously and rotatably drives the compressor impeller that may be carried within a compressor housing (not shown).

FIG. 3 shows a variable turbine geometry turbocharger with the turbine housing 218 having an exhaust gas inlet 220 and an outlet 222, a volute connected to the inlet 220, and a nozzle wall adjacent the volute (collectively referred to as the exhaust gas supply channel). A turbine wheel 212 is carried within the turbine housing and is attached to a shaft 216.

An array of pivotable vanes 234 are situated within the turbine housing 218 adjacent the nozzle wall and positioned between the exhaust gas inlet 220 and the turbine wheel 212. As exhaust gas passes through the supply channel to the turbine wheel 212, the exhaust gas flow can be controlled by pivoting the vanes 234 to be more or less open.

After impacting the turbine wheel 212, the exhaust gas flows axially through the turbine shroud and exits the turbocharger 210 through outlet 222 into either a suitable pollution-control device or the atmosphere.

The turbine housing 218 may be mounted to a flange 225 which may, in turn, be mounted to a center housing (not shown), or which could be a part of it. A compressor housing may be mounted on the other side of the center housing.

A first ring or a ring of elements defining static pivot points or a static ring 224 (which may also be affixed to the turbine housing or flange 225 but that could also be pivotable) may be situated concentrically with a second ring or a ring of actuation elements or actuator ring 248. An array of vanes 234 may be situated such that the vanes 234 may be positioned adjacent the two rings 224, 248. Although the rings may be presented as having a co-planar surface, this is not required. It is also perfectly acceptable to have the outer ring as the static ring 224 and the pivotable actuator ring 248 on the inside. Further, both rings 224, 248 may be pivotable. Pins, vane posts or connecting members 228 may extend between the static ring 224 and the vanes 234. Pins or actuation posts may also extend between the actuator ring 248 and the vanes 234 such that when one of the rings 224, 248 is rotated relative to the other ring 224, 248, the vanes 234 pivot. Note that although the rings 224, 248 are illustrated in a preferably coplanar relationship, this is not required for the mechanism to function. All that is preferably done is that the vanes 234 are connected to the rings 224, 248. Thus, the rings 224, 248 may be situated on opposite sides of the vanes 234 and it is not necessary that they be co-planar. The present disclosure also contemplates other structures and techniques for movement of the vanes 234 to control the nozzle throat and fluid communication therethrough.

The turbocharger 210 has a turbine housing insert ring 294. The turbine housing insert ring 294 can provide the benefits of a temperature buffer between the vanes 234 and the extremely hot turbine housing 218 (thus it is preferable that the material of the turbine housing insert ring 294 be well insulating). The actuator ring 248 contains a plurality of slots for receiving respective sliding blocks 254 and may include a main actuation slot for a main actuation block 258.

Figure 4:
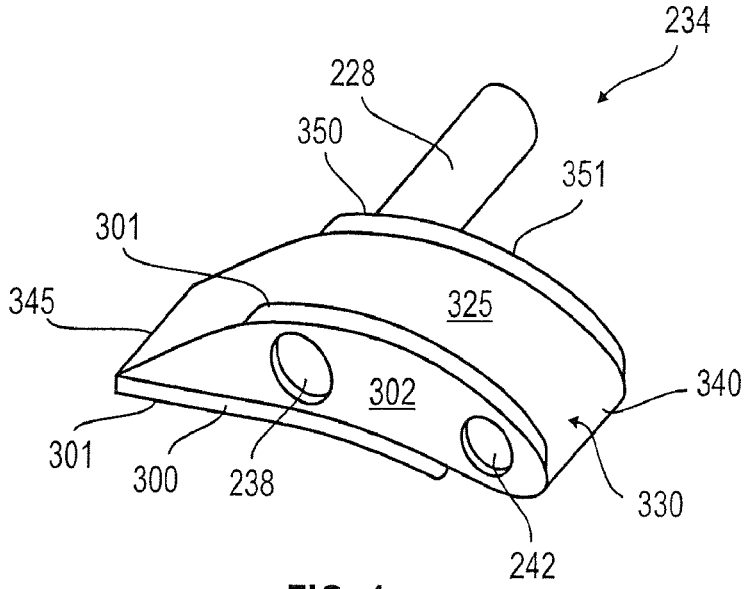
FIG. 4 is a perspective view of a vane according to an exemplary embodiment of the invention.
Figure 5:
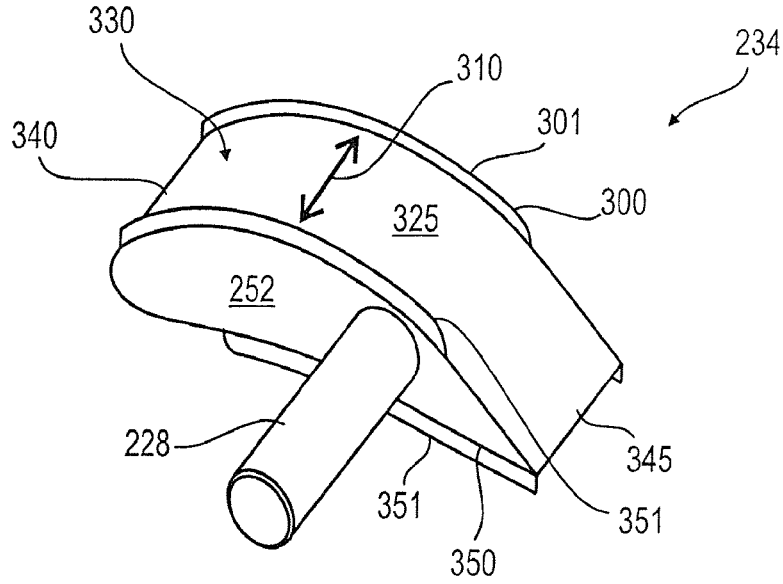
FIG. 5 is another perspective view of the vane of FIG. 4.
Figure 6:
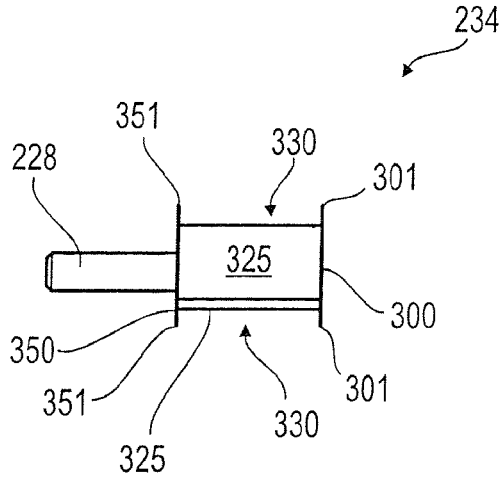
FIG. 6 is a plan view of the vane of FIG. 4.

Vane posts 228 may be press-fit into static ring bores 230 in the static ring 224 or, alternatively, into the flange 225. A respective vane 234 may be mounted to be capable of pivoting on a respective vane post 228. Each vane 234 can also include an actuation post that extends into a respective sliding block hole in a respective sliding block 254. The respective sliding block 254 may then be received into a respective slot in the actuator ring 248. Although, the present invention contemplates other actuation structures and techniques for the movable vanes 234, such as vanes that do not have the above-described blocks as shown in FIGS. 4-6.

An actuator assembly may be connected with the actuator ring 248 and thereby configured to pivot the actuator ring 248 in one direction or the other as necessary to move the vanes 234 radially, with respect to an axis of rotation of the respective vane post 228, outwardly or inwardly to respectively increase or decrease the local exhaust gas velocity to the turbine wheel 212. In order to pivot the vanes 234, any suitable actuator may be utilized. As illustrated in FIG. 3, a rotary electric actuator 227 may be utilized, though it is perfectly acceptable and within the scope of this invention to utilize a pneumatic, hydraulic, electronic, or other actuator. As illustrated, a linkage mechanism 229 may be utilized to transfer the rotational motion of the rotary electric actuator shaft to the actuator ring 248.

As the actuator ring 248 is pivoted, the actuation posts (in their respective sliding block 254 in one exemplary embodiment) may be caused to move within their respective slot from a slot first end to a slot second end. Because the slots are preferably oriented with a radial directional component along the actuator ring 248, the movement of the actuation posts (and respective sliding block 254) within the respective slot causes the vanes 234 to pivot via rotation of their respective vane post 228 and to open or close the nozzle area depending on the actuator ring 248 rotational direction.

The plurality of pivotable vanes 234 that operate to vary the geometry of the annular passage thereby control the angle at which the exhaust gas impacts the blades of the turbine wheel 212. This, in turn, controls the amount of energy imparted to the compressor wheel and, ultimately, the amount of air supplied to the engine. The vane posts 228 may be rotationally fixed in either the static ring 224 or the vane 234. Holes 238 and 242 allow for engagement of the vane posts 228 and the sliding blocks 254 with the vanes 234.

Referring to FIGS. 4-6, an exemplary embodiment of vane 234 is shown. Vane 234 has first and second side plates 300 and 350. The sideplates 300 and 350 can be attached to the vane 234, such as, for example, via welding, but are preferably integrally formed with the vane during casting. Such integral forming of the sideplates 300 and 350 with the vane 234 can include machining and the like. Sideplates 300 and 350 extend beyond the opposing gas bearing surfaces 325 of the vane 234 (only one of which is shown in FIGS. 4 and 5) to form channels 330 on opposing sides of the vane. Channels 330 provide a fluid flow path for the exhaust gases along the vanes 234 in a longitudinal direction of the vane. The sideplates 300 and 350 can have edges 301 and 351, respectively, that conform to the shape of the gas bearing surfaces 325, although other shapes are contemplated by the present disclosure for the edges.

The sideplates 300 and 350 that define the channels 330 reduce or eliminate leakage of the exhaust gases around the vanes 234, e.g., from the high pressure side of the vane to the low pressure side of the vane. Such leakage can occur in contemporary devices between the vanes and the adjacent or abutting structures such as the actuator ring and/or turbine housing insert ring. Such leakage decreases the efficiency of the variable geometry design by allowing a portion of the exhaust gas to contact the turbine wheel when such contact is not desired and/or allowing a portion of the exhaust gas to bypass the turbine wheel when such bypass is not desired. Channels 330 can form a U-shaped structure along all, some or a substantial portion of the gas bearing surfaces 325. Thus, the present disclosure contemplates one or both of the sideplates 300 and 350 extending along all, some or a substantial portion of the length of the gas bearing surfaces 325.

Figure 5A:
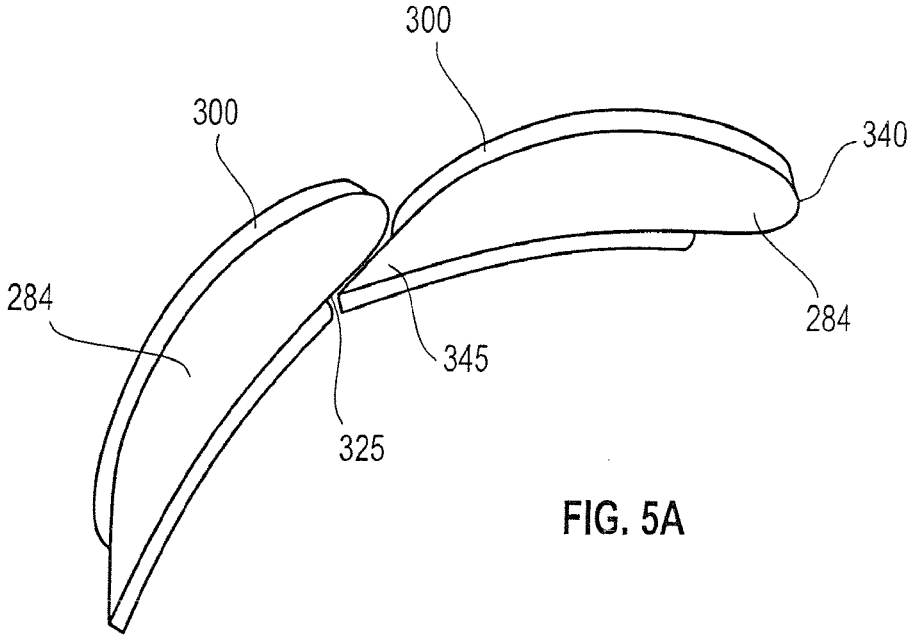
FIG. 5A is a plan view of adjacent vanes in sealing engagement according to the exemplary embodiment of FIG. 4.

Sideplates 300 and 350 are preferably formed along a length of the gas bearing surface 325 that allows a sealing engagement of the leading edge 340 of one vane 234 with the trailing edge 345 of another vane, as shown in FIG. 5A. The present disclosure also contemplates other structures being used to facilitate the sealing engagement between adjacent vanes 234.

Figure 5B:
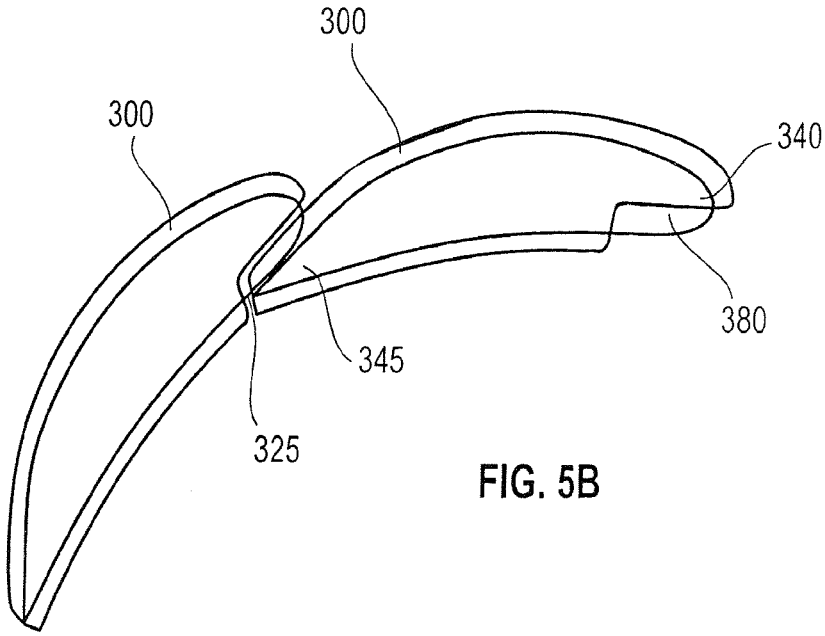
FIG. 5B is a plan view of adjacent vanes in sealing engagement according to another exemplary embodiment of the invention.

As shown in FIG. 5B, portions of vanes 234 can nest with each other to improve the sealing engagement of adjacent vanes. In such a nesting engagement, a reduced portion 380 of the outer surfaces 302 and 352 of the vanes 234 can be provided so that the sideplates 300 and 350 can be nested with the reduced portion. The reduced portion 380 can be along the outer surfaces 302 and 352 of the leading edge 340. The reduced portion 380 can be defined by a cut-out or the like in the sideplates 300 and 350. Additional material may be removed from the outer surfaces 302 and 352 at or in proximity to the reduced portion 380 to facilitate the nesting of the adjacent vanes and/or to maintain adequate clearance to prevent sticking of the vanes 234. In this embodiment, the sideplates 300 and 350 extend up to the reduced portion 380 along the gas bearing surface 325 that is in proximity to the turbine wheel. The present disclosure contemplates providing nesting of the leading edge 340 of one vane 234 with the trailing edge 345 of an adjacent vane using other techniques and/or structures, including providing the reduced portion 380 along outer surfaces 302 and 352 near the leading edge of the vanes.

While the channels 330 of FIGS. 4-6 define U-shaped channels, the present disclosure contemplates the formation of other shaped channels along all, some or a substantial portion of the length of the gas bearing surfaces 325. The channels 330 can be defined by any curvature or non-planar portion of the gas bearing surfaces 325 in a traverse direction 310 of the vane 234. The channels 330 can be defined by other curved or non-planar surfaces that traverse the gas bearing surfaces 325, such as, for example, semi-cylindrical or V-shaped surfaces. Such curved or non-planar shapes of the gas bearing surfaces 325 provide the edges 301 and 351 which extend beyond the gas bearing surfaces and reduce or eliminate leakage around the vane 234 via improved sealing with the adjacent or abutting components such as the actuator ring 248 and/or turbine housing insert ring 294.

The sideplates 300 and 350 preferably have outer surfaces 302 and 352, respectively, that are substantially flat to facilitate movement of the vanes 234 with respect to the adjacent or abutting components such as the actuator ring 248 and/or turbine housing insert ring 294. The use of sideplates 300 and 350 has the advantage of providing improved aerodynamic performance with the same width constraint for the vane 234, greater side clearance which reduces the cost of assembly, and improved strength for the assembly of the vane 234 with the vane post 228 by providing a larger, stronger mounting area.

Preferably, the sideplates 300 and 350 are integrally formed with the vane 234 during casting. The sideplates 234 can be made from the same material as the vane 234 or can be made from different materials. The particular size (including length, height, thickness and/or dimensional uniformity) and shape of the sideplates 300 and 350 can be chosen to facilitate sealing of the vanes 234 with the adjacent or abutting components such as the actuator ring 248 and/or turbine housing insert ring 294, as well as other factors such as ease of assembly. While the embodiment of FIGS. 4-6 describes sideplates 300 and 350 being formed or connected to opposing side surfaces of the vane 234, the present disclosure contemplates the U-shaped or other shaped channels 330 being separate channel-like structures (e.g., U-brackets) that are connected to the vane along the opposing gas bearing surfaces 325. The present disclosure contemplates the sideplates 300 and 350 being formed by other structures, e.g., beads, positioned along the gas bearing surfaces 325, including weld beads and the like.

Figure 7:
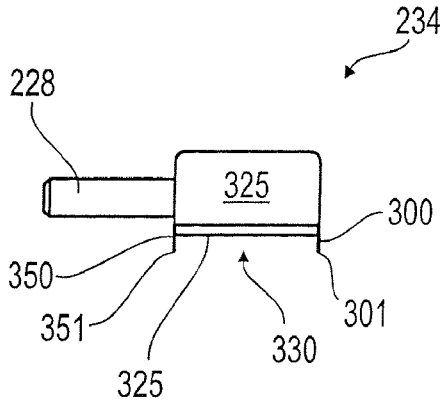
FIG. 7 is a plan view of a vane according to another exemplary embodiment of the invention.

While the embodiment of FIGS. 4-6 describes a vane 234 with sideplates 300 and 350 defining channels 330 on opposing gas bearing surfaces 325 of the vane, the present disclosure contemplates forming such channels on only one of the gas bearing surfaces as shown in FIG. 7. The embodiment of FIG. 7, provides for leakage control via the sideplates 300 and 350 when the vanes 234 are moved to a position to increase the supply to the turbine wheel with the exhaust gas.

Figure 8:
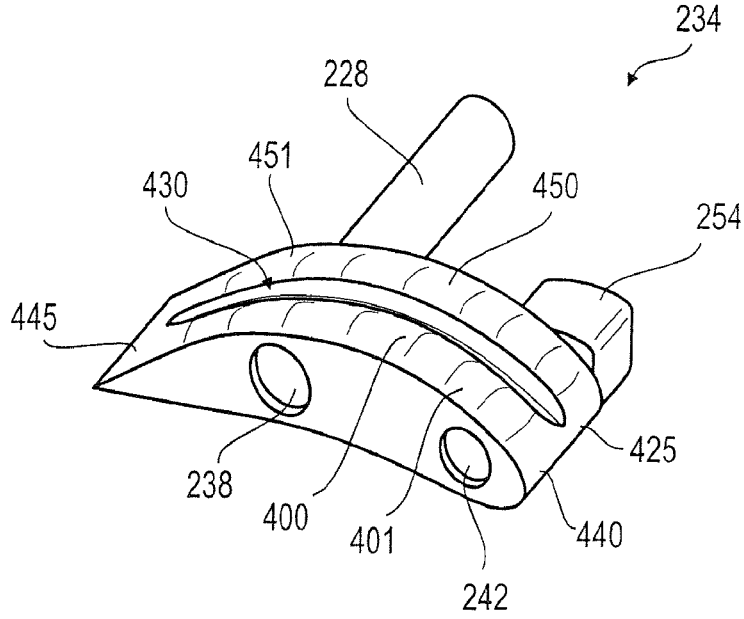
FIG. 8 is a perspective view of a vane according to another exemplary embodiment of the invention.
Figure 9:
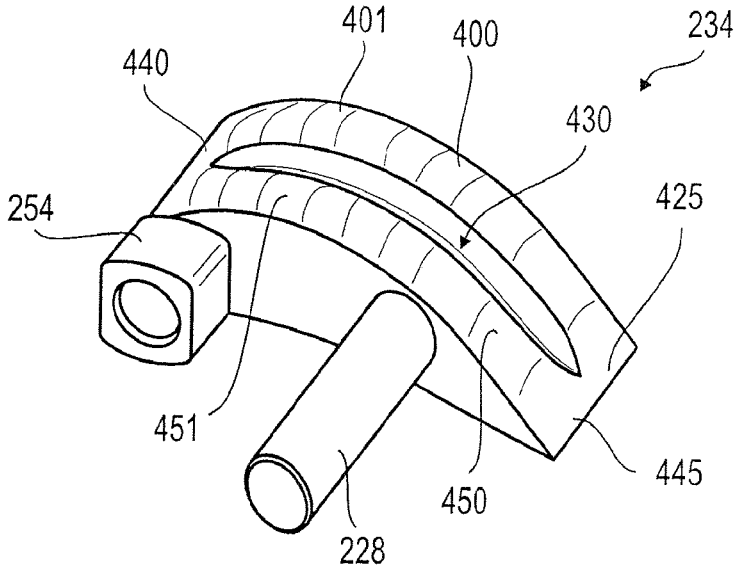
FIG. 9 is another perspective view of the vane of FIG. 8.
Figure 10:
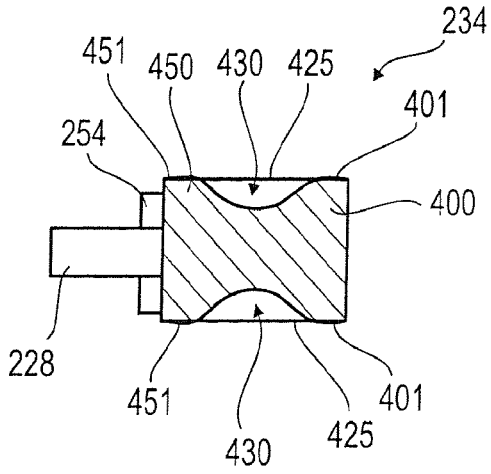
FIG. 10 is a cross-sectional view of the vane of FIG. 8.

Referring to FIGS. 8-10, another exemplary embodiment of vane 234 is shown. Vane 234 has first and second walls 400 and 450 that define channels 430. The walls 400 and 450 can be cast into the vane 234 and/or the channels 430 can be machined or otherwise formed into the gas bearing surface 425 via a secondary process. Channels 430 provide a fluid flow path for the exhaust gases along the vanes 234. The walls 400 and 450 preferably have edges or upper portions 401 and 451 that form an outer extent of the gas bearing surfaces 425.

Figure 8A:
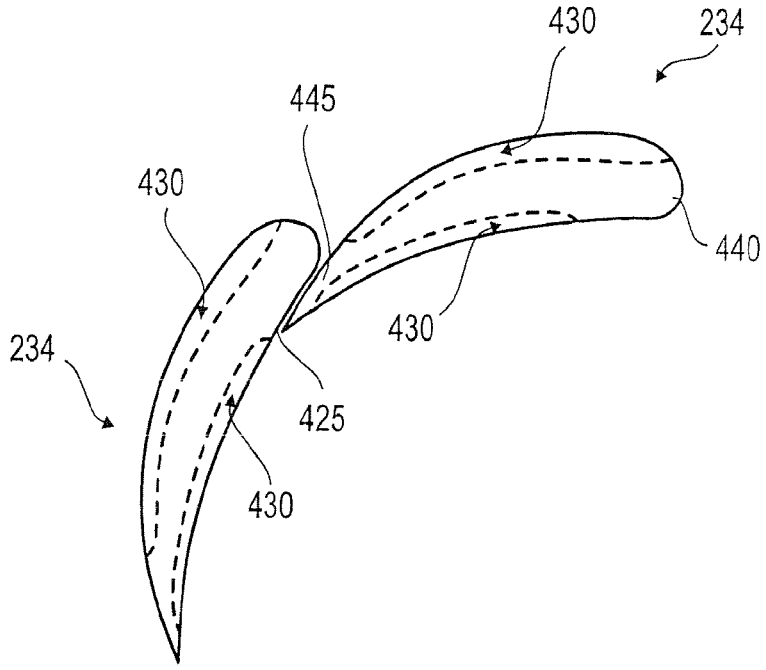
FIG. 8A is a plan view of adjacent vanes in sealing engagement according to the exemplary embodiment of FIG. 8.

The channels 430 and upper portions 401 and 451 reduce or eliminate leakage of the exhaust gases around the vanes 234, e.g., from the high pressure side of the vane to the low pressure side of the vane as described above. The particular size (including length, depth and/or width), shape, direction and number of the channels 430 can be chosen to facilitate the leakage control and/or based upon other factors such as cost and flow control, e.g., turbulence reduction. In the embodiment of FIGS. 8-10, the channels 430 are substantially symmetrical and smooth as shown more clearly in FIG. 10. However, the present disclosure contemplates other shapes for channels 430 including non-symmetrical, non-smooth, concave and/or convex shapes, which can be positioned along all, some or a substantial portion of the gas bearing surfaces 425. Thus, the present disclosure contemplates one or both of the upper portions 401 and 451 extending along all, some or a substantial portion of the length of the gas bearing surfaces 425. Preferably, channels 430 do not extend fully to the leading edge 440 and trailing edge 445 so that adjacent vanes can sealingly engage with each other via abutting gas bearing surfaces 425 as shown in FIG. 8A. Where two channels 430 are used on opposing surfaces of the vane 234, the channels can be of the same shape or can be of different shapes.

Figure 11:
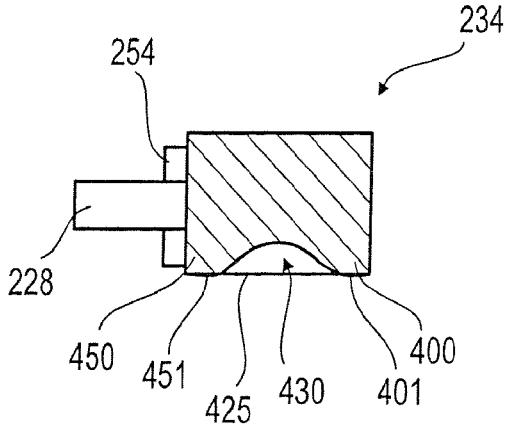
FIG. 11 is a cross-sectional view of another exemplary embodiment of a vane of the invention.

While the embodiment of FIGS. 8-10 describes a vane 234 with walls 400 and 450 defining channels 430 on opposing gas bearing surfaces 425 of the vane, the present disclosure contemplates forming such channels on only one of the gas bearing surfaces as shown in FIG. 11. The embodiment of FIG. 11, provides for leakage control via the walls 400 and 450 and the channel 430 when the vane 234 is in a position to increase supply to the turbine wheel with the exhaust gas.

Figure 12:
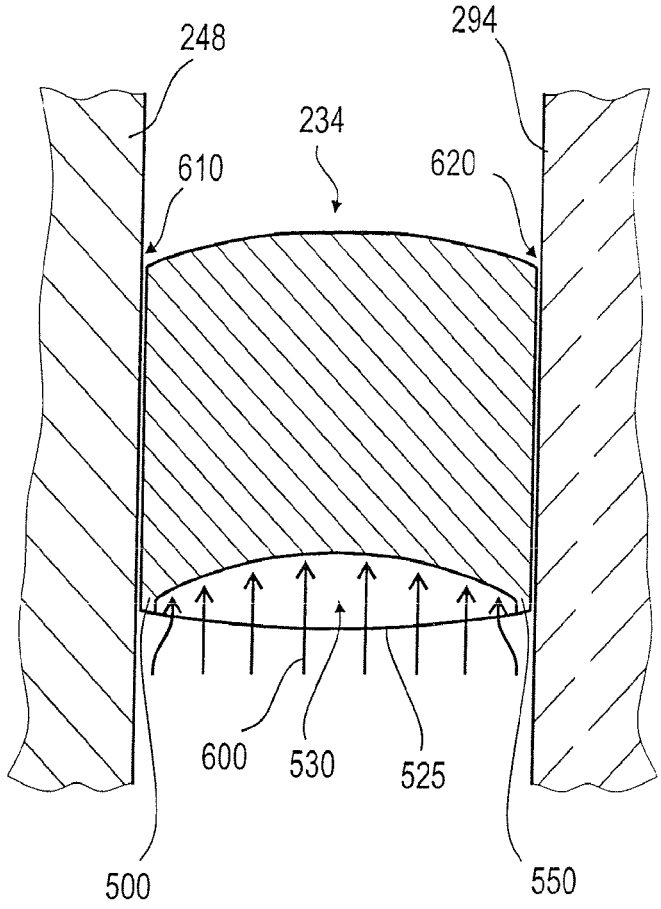
FIG. 12 is a cross-sectional view a vane according to another exemplary embodiment of the invention.

Referring to FIG. 12, a cross-sectional view of another exemplary embodiment of vane 234 is shown. Vane 234 is positioned between the actuator ring 248 and the turbine housing insert ring 294. The vane 234 has walls 500 and 550 that are formed along the gas bearing surface 525 in proximity to the turbine wheel. The exhaust gas path is schematically represented by arrows 600 which shows the leakage control provided by walls 500 and 550 that define the channel 530.

The exhaust gas at least along the periphery of the gas bearing surface 525 is directed towards a center of the gas bearing surface by the walls 500 and 500. The walls 500 and 550 and channel 530 reduce or eliminate leakage along the interstices 610 and 620. The smooth, concave shape of the channel 530 can facilitate flow and avoid adding turbulence prior to the gas making contact with the turbine wheel. As described above, the channel 530 can be formed by various structures and techniques including, but not limited to, sideplates, separate channeled structures, machined or cast channels, beads, and the like.

Another exemplary embodiment concerns a turbocharger with variable turbine geometry (VTG). Such a variable turbine geometry can have pivotably mounted vanes which are arranged in a flow channel which is bounded by two walls. One of these walls can be defined, at least in part, by a vane mounting ring, in which the shafts of the vanes are mounted, and the axially opposite second wall can be formed by the turbine housing or by a disk arranged in the turbine housing.

In one embodiment, the VTG cartridge of such a turbocharger can include a guide system (guide cascade) with vanes and levers and a disk on the turbine housing side. A VTG arrangement is shown in European Patent Application EP-A-1 422 385, the disclosure of which is hereby incorporated by reference. The flow channel can be formed between the vane mounting ring and disk, in which the vanes of the VTG are situated. In one embodiment, the vane shafts can be mounted in holes in the vane mounting ring.

The exemplary embodiment of the turbocharger and/or the vane of the guide system can increase the efficiency of the guide system in comparison to known constructions by increasing the throttling action of the axial gap of the vanes.

Figure 13:
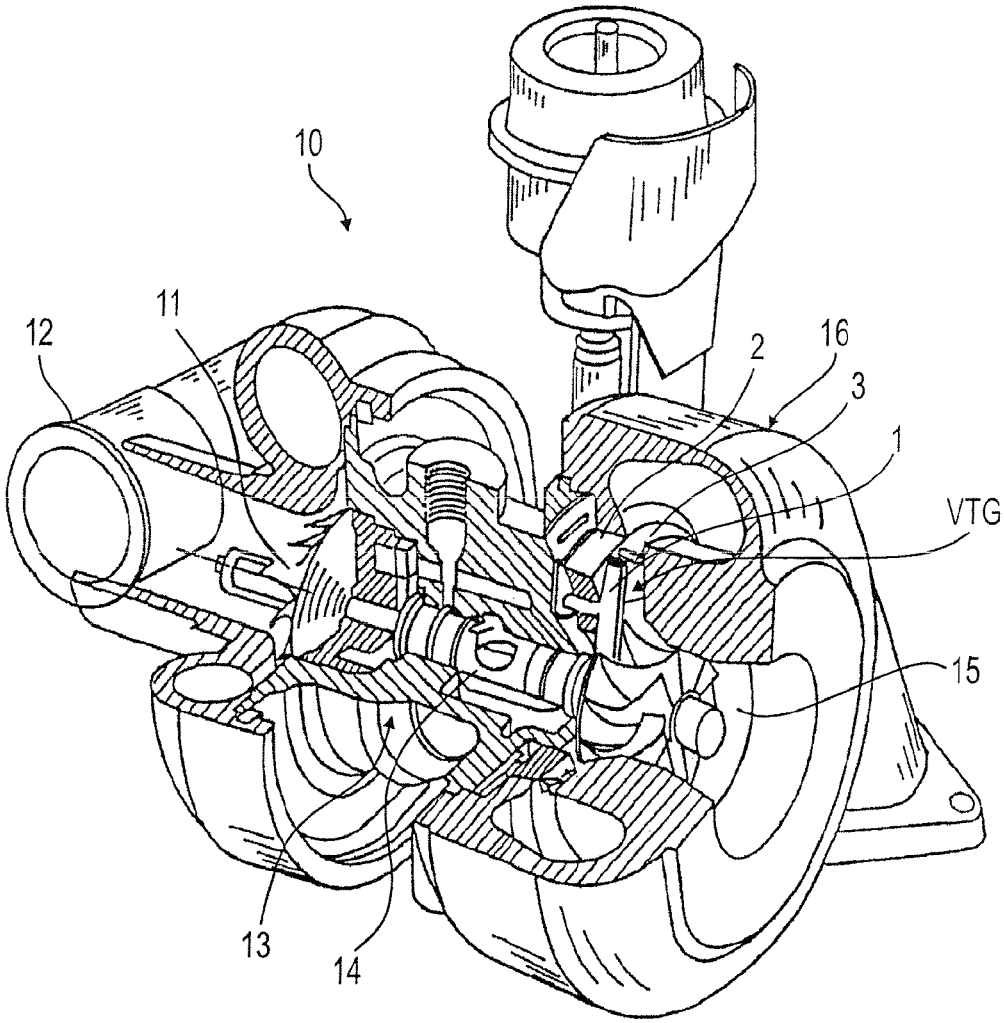
FIG. 13 is a perspective view of another exemplary embodiment of a VTG turbocharger.

Since a complete explanation of all the construction details of a turbocharger with variable turbine geometry is not required for the description which follows of the construction principles according to one exemplary embodiment, FIG. 13 depicts only the fundamental components of a turbocharger 10 according to the exemplary embodiment, which comprises a compressor wheel 11 in a compressor housing 12, a bearing housing 13 with the required bearings for the shaft 14, and a turbine wheel 15 in a turbine housing 16. The VTG comprises a vane mounting ring arrangement with a vane 1 which is pivotably mounted in a vane mounting ring 2 and is arranged between this ring and a housing wall 3, or optionally a disk (not shown in FIG. 13). The remaining parts of the turbocharger are not required for the explanation of the exemplary embodiment, although they are of course provided.

Figure 14:
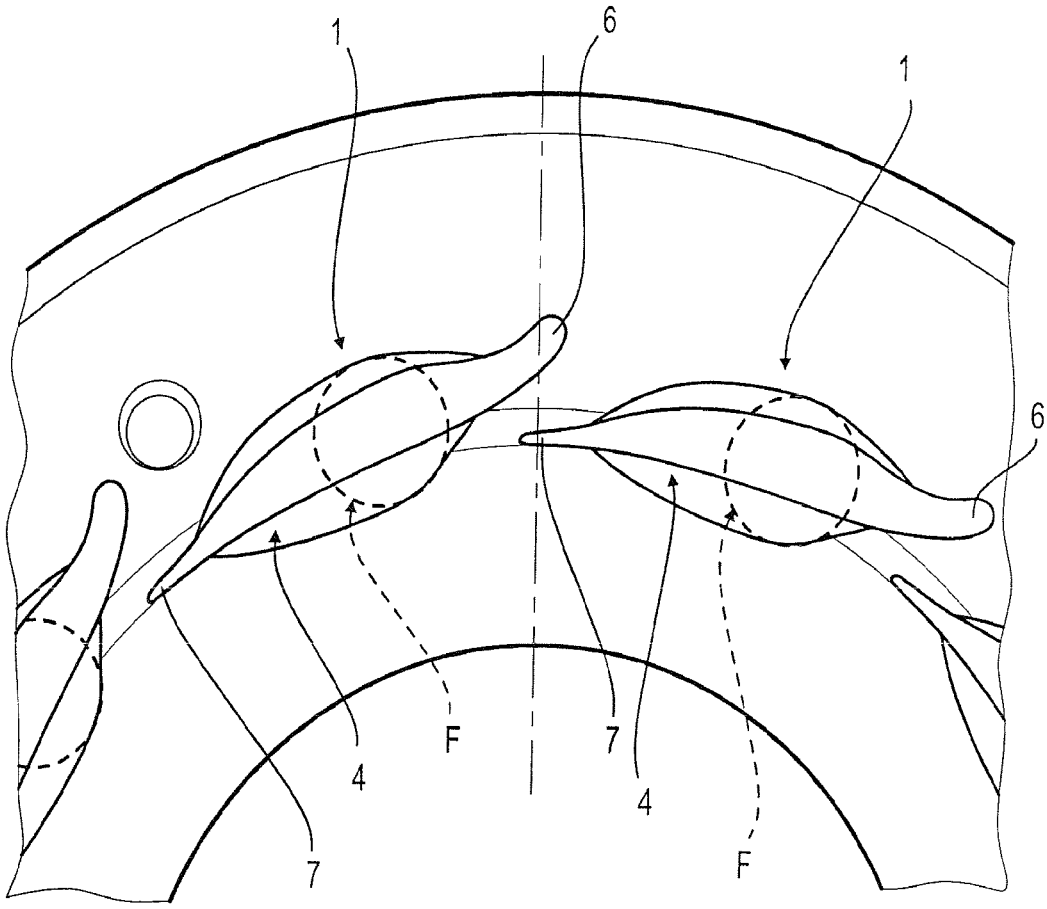
FIG. 14 is a sectional view of the VTG of the turbocharger with the vanes and the respective sealing flange according to another exemplary embodiment of invention formed thereon.

FIG. 14 shows a plan view of the VTG, as seen from the direction of the disk 3, which depicts a plurality of vanes 1 each having a sealing flange arrangement 4 according to the invention formed thereon. As can be seen from FIG. 14, the sealing flange arrangement 4 in this embodiment has a substantially oval shape which extends between a vane head 6 and a vane tail 7. For comparison with the known construction, the periphery of the circular prior art sealing flange F is in each case indicated by a dashed line.

Figure 15A:
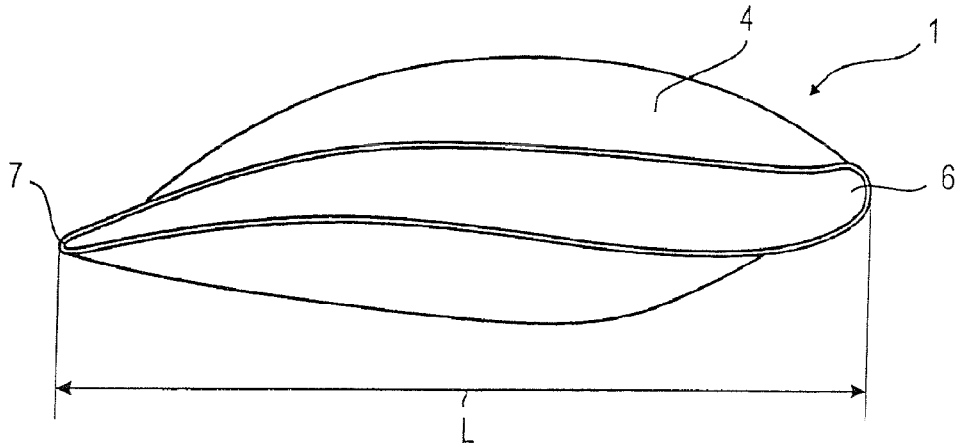
FIGS. 15A, B are views of vanes on an enlarged scale and according to other exemplary embodiments.
Figure 15B:
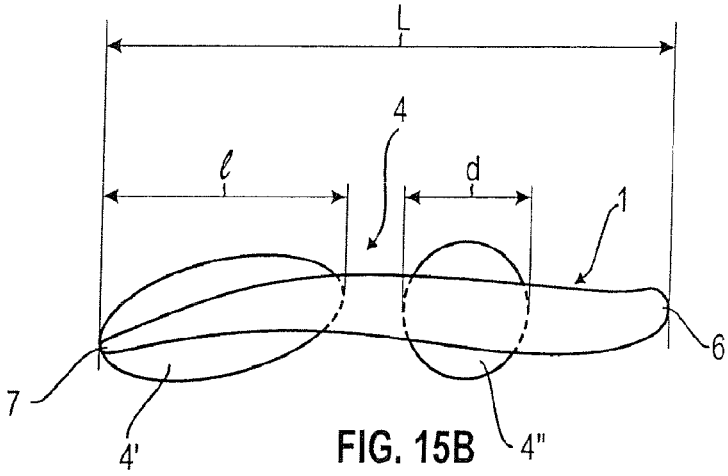

FIG. 15A is a view of a further embodiment of the vane 1 on an enlarged scale. As represented in FIG. 15A, the vane 1 has, from the vane head 6 to the vane tail 7, the vane length L. In this embodiment, the sealing flange arrangement 4 is formed virtually over the entire length L of the vane 1. FIG. 15B shows a further embodiment in which the sealing flange arrangement 4 is arranged with prime importance in the vicinity of the vane tail (vane end) 7, since the vane thickness is narrowest at this point and a sealing action provided by the sealing flange section 4' has a very considerable influence. Furthermore, provision is made here for the sealing action to be achieved by splitting the sealing flange arrangement 4 into a plurality of sealing flange sections 4' and 4", so that a circular sealing flange section 4" is provided in the region of the vane shaft in this embodiment, although this is not absolutely necessary since the sealing flange section 4' alone also provides considerable improvements in terms of the sealing action.

Figure 16:
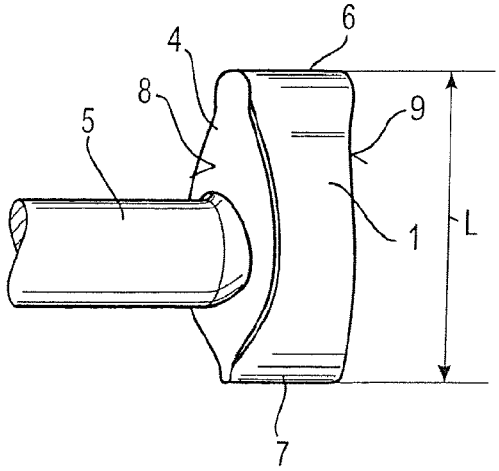
FIG. 16 is a perspective view of the entire vane element of FIG. 15A.

FIG. 16 shows a perspective view of the entire vane element, with a vane 1 connected to a shaft 5. The sealing flange arrangement 4 is arranged on one end face 8 of the end faces 8 and 9 of the vane 1 and extends, as has already been shown in the plan view of FIG. 3, over a large region of the vane length L, from the vane head 6 to the vane tail 7 of the vane 1. By virtue of the approximately oval sealing flange arrangement 4 extended toward the vane head 6 and toward the vane tail 7, there is achieved an increase in the sealing area, and hence a reduction in the leakage flow through the axial gap, and an improvement in the efficiency of the turbocharger, in particular at low engine speeds.

It should be understood that features of the various exemplary embodiments can be interchangeable with one another. The foregoing description is provided in the context of exemplary embodiments of vanes and vane assemblies for a turbocharger. Thus, it will of course be understood that the invention is not limited to the specific details described herein, which are given by way of example only, and that various modifications and alterations are possible within the scope of the invention as defined in the following claims.

What is claimed is:

1. A vane (234) for a variable geometry turbocharger (210), the vane (234) comprising:

a body having a leading edge (340, 440), a trailing edge (345, 445), a gas bearing surface (325, 425) therebetween and a channel (330, 430) along at least a substantial portion of the length of the gas bearing surface (325, 425) in a longitudinal direction of the body;

first and second sideplates (300, 350) opposing each other and at least partially define the channel (330, 430), the first and second sideplates (300, 350) being substantially parallel to each other, and a connection member (228) operably connected to the body and allowing movement of the vane (234).

2. The vane (234) of claim 1, wherein the first and second sideplates (300, 350) are integrally cast with the body.

3. The vane (234) of claim 1, wherein the channel (330, 430) is first and second channels (330, 430) along opposite surfaces of the body.

4. The vane (234) of claim 1, wherein the channel (330, 430) has a U-shape.

5. The vane (234) of claim 1, wherein at least one of the first and second sideplates (300, 350) has an edge (301, 351) that conforms to a shape of the gas bearing surface (325, 425).

6. The vane (234) of claim 1, wherein at least one of the first and second sideplates (300, 350) has a hole therein, and wherein the connection member (228) is a vane shaft (228) positioned through the hole.

7. A variable geometry turbocharger (210) comprising:

an exhaust gas inlet (220);

an exhaust gas outlet (222);

a turbine wheel (212) in fluid communication with the exhaust gas inlet (220) and outlet (222);

a vane (234) having a leading edge (340, 440), a trailing edge (345, 445), a gas bearing surface (325, 425) between the leading and trailing edges (340, 345, 440, 445) and a channel (330, 340) along at least a substantial portion of the length of the gas bearing surface (325,425) in a longitudinal direction of the vane (234), the vane (234) being in fluid communication with the exhaust inlet (220) and turbine wheel (212); and a connection member (228) operably connected to the vane (234) and allowing movement of the vane (234) to control flow of exhaust gas to the turbine wheel (212), wherein the gas bearing surface (325, 425) is non-planar in a traverse direction of the vane (234).

8. The turbocharger (210) of claim 7, wherein the vane (234) has first and second sideplates (300, 350) that at least partially define the channel (330, 430).

9. The turbocharger (210) of claim 8, wherein the first and second sideplates (300, 350) are integrally cast with the vane (234).

10. The turbocharger (210) of claim 8, wherein at least one of the first and second sideplates (300, 350) has an edge (301, 351) that conforms to a shape of the gas bearing surface (325, 425).

11. The turbocharger (210) of claim 8, wherein at least one of the first and second sideplates (300, 350) has a hole therein, and wherein the connection member (228) is a vane shaft (228) positioned through the hole.

12. The turbocharger (210) of claim 8, wherein adjacent vanes (234) nest with each other along at least a portion of the channel (330, 430).

13. The turbocharger (210) of claim 12, wherein the vane (234) has a reduced portion (380) where adjacent vanes (234) nest with each other.

14. The turbocharger (210) of claim 7, wherein the at least one channel (330, 430) has a U-shape.

15. The turbocharger (210) of claim 7, wherein the channel (330, 340) is at least partially formed within the gas bearing surface (325, 425).

16. A method of controlling leakage of gas in a variable geometry turbocharger (210) from a high pressure side of a vane (234) to a low pressure side of the vane (234), the method comprising:

providing a gas bearing surface (325, 425) along the high pressure side of the vane (234) and directing flow of at least a portion of the gas towards a center of the gas bearing surface (325, 425) by at least a channel (330, 430) along at least a substantial portion of the length of the gas bearing surface (325, 425) in a longitudinal direction of the vane (234).

17. The method of claim 16, further comprising reducing turbulence of the gas along the gas bearing surface (325, 425) through use of a non-planar shape of the gas bearing surface (325, 425).

18. The method of claim 16, wherein the channel (330, 430) is formed by at least one sideplate (300, 350) of the vane (234).

19. The method of claim 16, wherein the channel (330, 430) is at least partially formed within the gas bearing surface (325, 425).

* * * * *